US010388089B1

(12) United States Patent
Civgin et al.

(10) Patent No.: US 10,388,089 B1
(45) Date of Patent: Aug. 20, 2019

(54) DYNAMICALLY CONTROLLING SENSORS AND PROCESSING SENSOR DATA FOR ISSUE IDENTIFICATION

(71) Applicant: Allstate Insurance Company, Northbrook, IL (US)

(72) Inventors: Dogan Civgin, Northfield, IL (US); Matthew James Manzella, Glen Ellyn, IL (US)

(73) Assignee: Allstate Insurance Company, Northbrook, IL (US)

( * ) Notice: Subject to any disclaimer, the term of this patent is extended or adjusted under 35 U.S.C. 154(b) by 64 days.

(21) Appl. No.: 15/597,595

(22) Filed: May 17, 2017

(51) Int. Cl.
*G07C 5/08* (2006.01)
*G08G 1/123* (2006.01)

(52) U.S. Cl.
CPC ..... *G07C 5/0816* (2013.01); *G07C 5/0808* (2013.01); *G08G 1/123* (2013.01)

(58) Field of Classification Search
None
See application file for complete search history.

(56) References Cited

U.S. PATENT DOCUMENTS 5,760,708 A 6/1998 Seith
6,246,934 B1 6/2001 Otake et al.
6,583,734 B2 6/2003 Bates et al.
6,828,924 B2 12/2004 Gustavsson et al.
7,002,486 B2 2/2006 Lawrence
7,053,761 B2 5/2006 Schofield et al.
7,103,460 B1 9/2006 Breed
7,346,439 B2 3/2008 Bodin
7,711,462 B2 5/2010 Daniels et al.
8,063,756 B2 11/2011 Watabe
8,355,852 B2 1/2013 Grimm et al.
8,626,208 B2 1/2014 Oesterling et al.
8,655,537 B2 2/2014 Ferguson et al.
9,014,960 B2 4/2015 Bresnahan et al.
9,142,128 B2 9/2015 Shin et al.
9,167,418 B1 10/2015 Tuluca
(Continued)

OTHER PUBLICATIONS

"Discover Networkfleet Features", Verizon, downloaded from <http://www.networkfleetcom/features/> on Nov. 28, 2016.
(Continued)

*Primary Examiner* — Lail A Kleinman
(74) *Attorney, Agent, or Firm* — Banner & Witcoff, Ltd.

(57) ABSTRACT

Systems and apparatuses for identifying a type of issue associated with a stopped vehicle are provided. The system may determine a current location of the vehicle and determine whether the vehicle is currently located on a highway. In some examples, the determined location of the vehicle may cause the system to transmit instructions controlling an amount or type of data collected by sensors and/or transmitted to the system. If the vehicle is on a highway, the system may then determine whether the vehicle is stopped. If so, the system may determine a reason for the vehicle stopping. Upon determining that the vehicle is stopped for an urgent reason, the system may transmit a request for roadside assistance to a service provider computing device and may generate a first type of notification. Upon determining that the vehicle is stopped for a non-urgent situation reason, the system may generate and transmit a second type of notification for display.

20 Claims, 9 Drawing Sheets

(56) References Cited

U.S. PATENT DOCUMENTS

| | | | | |
|---|---|---|---|---|
| 9,406,177 | B2 | 8/2016 | Attard et al. | |
| 2013/0302758 | A1* | 11/2013 | Wright | G07C 5/008 434/65 |
| 2016/0071418 | A1 | 3/2016 | Oshida et al. | |
| 2016/0078692 | A1 | 3/2016 | Tutte | |
| 2016/0223344 | A1* | 8/2016 | Sanami | G01C 21/30 |
| 2018/0302484 | A1* | 10/2018 | Kothari | H04W 4/40 |

OTHER PUBLICATIONS

"Roadside Assistance", Premier GPS Tracking, downloaded from <http://www.premierpgstracking.com/roadside-assistance/> on Nov. 28, 2016.

"Breakdowns Happen. We Help Get You Back on the Road", GPSTrackit, downloaded from <http://gpstrackit.com/best-roadside-assistance-for-your-fleet/>, on Nov. 30, 2016.

"What to Do (And Not to Do) After a Highway Breakdown", Automotive Fleet Magazine, Aug. 2013, downloaded from <http://www.automotive-fleet.com/article/story/2013/07/what-to-do-and-not-to-do-after-a-highway-breakdown.aspx> on Nov. 28, 2016.

"Stopped Vehicle Detection", Video Analytic Software, downloaded from ,http://www.i2vsys.com/stopped-vehicle-detection.html> on Nov. 28, 2016.

"Stopped Vehicle Detection (SVD)—Improving Safety on Highways", NavTech Radar, downloaded from <http://www.navtechradar.com/stopped-vehicle-detection-highways/> on Nov. 28, 2016.

* cited by examiner

DYNAMICALLY CONTROLLING SENSORS AND PROCESSING SENSOR DATA FOR ISSUE IDENTIFICATION

FIELD OF ART

Aspects of the disclosure relate to data processing systems. In some examples, the systems process data in real-time, control an amount or type of data collected and/or transmitted for processing and identify issues and types of issues associated with a stopped vehicle.

BACKGROUND

Vehicles, such as automobiles, may stop along a roadside for various different reasons. For instance, when traveling along a highway, vehicles may stop for various reasons, such as at a rest stop, to make a phone call, to research the area, because the driver has missed an exist, or for various emergency reasons, such as a flat tire, low fuel, or other mechanical issue. Obtaining roadside assistance can be difficult when in an unfamiliar area. Accordingly, convention systems may offer roadside assistance. However, these conventional systems often do not distinguish between vehicles being stopped for an urgent situation or a non-urgent situation. Accordingly, it would be advantageous to identify a type of issue causing a vehicle to stop and provide different types of assistance based on the type of issue.

BRIEF SUMMARY

In light of the foregoing background, the following presents a simplified summary of the present disclosure in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

Aspects of the disclosure related to systems and arrangements for receiving (e.g., in real-time) first data associated with a location of a vehicle. The first data may be analyzed (e.g., in real-time) to determine the location of the vehicle and determine whether the vehicle is currently located on a highway. In some examples, the determined location of the vehicle may cause the system to transmit instructions or commands controlling or modifying an amount or type of data collected by sensors in a user computing device, a vehicle, or the like, and/or transmitted to a system, such as a breakdown detection computing platform, for processing.

If the vehicle is determined to be on a highway, the system may then determine (e.g., in real-time) whether the vehicle is stopped. If so, the system may determine (e.g., in real-time) a reason for the vehicle stopping (e.g., an urgent situation vs. a non-urgent situation). In some examples, this determination may be made based on a scan of diagnostic codes associated with the vehicle, data from other vehicles in the area, and the like.

Upon determining that the vehicle is stopped for an urgent reason, the system may transmit a request for roadside assistance to a service provider computing device. In addition, the system may generate a first type of notification including an indication that a request for roadside assistance has been placed, an estimated time of arrival of assistance, and the like.

Upon determining that the vehicle is stopped for a non-urgent situation reason, the system may generate and transmit a second type of notification for display. The second type of notification may include an offer to request roadside assistance, information about the surrounding area, and the like.

The arrangements described may also include other additional elements, steps, computer-executable instructions, or computer-readable data structures. In this regard, other embodiments are disclosed and claimed herein as well. The details of these and other embodiments of the present invention are set forth in the accompanying drawings and the description below. Other features and advantages of the invention will be apparent from the description, drawings, and claims.

BRIEF DESCRIPTION OF THE DRAWINGS

The present invention is illustrated by way of example and is not limited by the accompanying figures in which like reference numerals indicate similar elements and in which.

DETAILED DESCRIPTION

Figure 1:
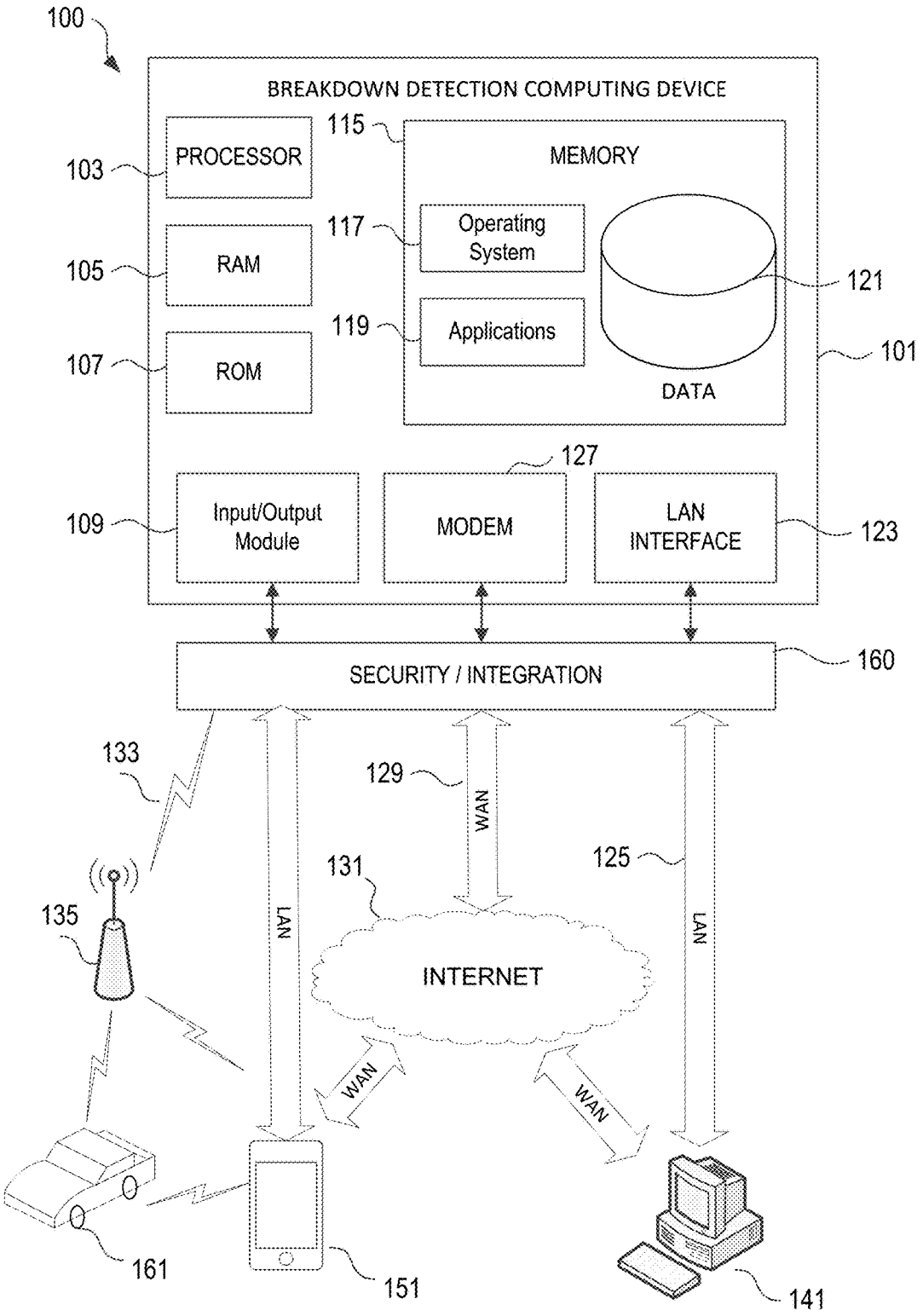
FIG. 1 illustrates one example operating environment in which one or more aspects described herein may be implemented.

In the following description of the various embodiments, reference is made to the accompanying drawings, which form a part hereof, and in which is shown by way of illustration, various embodiments of the disclosure that may be practiced. It is to be understood that other embodiments may be utilized.

As will be appreciated by one of skill in the art upon reading the following disclosure, various aspects described herein may be embodied as a method, a computer system, or a computer program product. Accordingly, those aspects may take the form of an entirely hardware embodiment, an entirely software embodiment or an embodiment combining software and hardware aspects. Furthermore, such aspects may take the form of a computer program product stored by one or more computer-readable storage media having computer-readable program code, or instructions, embodied in or on the storage media. Any suitable computer-readable storage media may be utilized, including hard disks, CD-ROMs, optical storage devices, magnetic storage devices, and/or any combination thereof. In addition, various signals representing data or events as described herein may be transferred between a source and a destination in the form of electromagnetic waves traveling through signal-conducting media such as metal wires, optical fibers, and/or wireless transmission media (e.g., air and/or space).

As will be discussed more fully herein, arrangements described herein are directed to determining a location of a vehicle, determining a reason the vehicle is stopped and generating and transmitting for display one or more different types of notifications. Conventional roadside assistance systems often require a user to provide information about an issue that has occurred, request assistance, or the like. If stopped in an emergency situation on a highway, this can be difficult for a user and sometimes dangerous. Accordingly, it is advantageous to detect issues that have caused a vehicle to stop along a highway and automatically provide assistance if the reason for stopping is urgent or provide an offer of assistance or additional information if the reason for stopping is not urgent.

In some examples, the system may receive, in real-time, first data including data associated with a location of a vehicle. In some examples, the system may determine the location of the vehicle (e.g., in real-time) and determine whether the current location of the vehicle is on a highway. In some examples, a highway may include roadways having a speed limit above a certain threshold, may have a maximum number of traffic control devices (e.g., stop signs, traffic lights, or the like) within a predetermined distance, or the like. For example, a highway may be a roadway having at least a speed limit of 40 miles per hour and having no more than 1 traffic control device in a two mile distance. In another example, a highway may be any roadway having at least a speed limit of 50 miles per hour and no more than one traffic control signal in a 10 mile distance. Various other example speed limits, traffic signal limitations, and the like, may be used without departing from the invention.

If based on the determined location of the vehicle (e.g., on a highway, not on a highway) the system may transmit instructions to control an amount or type of data collected and/or transmitted to the system for processing. The system may then receive, for example in real-time, second data. The system may process the second data (e.g., in real-time) to determine whether the vehicle is stopped. If so, the system may determine (e.g., in real-time) whether the vehicle has exited the highway. If not, the system may determine whether a cause of an issue causing the vehicle to stop is an urgent situation reason or a non-urgent situation reason. Based on the determination, different types of notifications may be generated and transmitted for display on one or more computing devices.

These and various other arrangements will be described more fully herein.

FIG. 1 illustrates a block diagram of one example breakdown detection computing device (or system) 101 in a computer system 100 that may be used according to one or more illustrative embodiments of the disclosure. The breakdown detection computing device 101 may have a processor 103 for controlling overall operation of the device 101 and its associated components, including RAM 105, ROM 107, input/output module 109, and memory 115. The breakdown detection computing device 101, along with one or more additional devices (e.g., terminals 141 and 151, security and integration hardware 160) may correspond to any of multiple systems or devices described herein, such as personal mobile devices, vehicle-based computing devices, insurance systems servers, roadside assistance provider servers, breakdown detection servers, internal data sources, external data sources and other various devices in a breakdown detection system. These various computing systems may be configured individually or in combination, as described herein, for receiving signals and/or transmissions from one or more computing devices, the signals or transmissions including data related to location of a vehicle, operating parameters of a vehicle, operating parameters of vehicle in a same or similar location to the vehicle, and the like, processing the signals or transmissions to determine a location of the vehicle, operating parameters of the vehicle, a cause of an issue associated with the vehicle, and the like, using the devices of the breakdown detection systems described herein. In addition to the features described above, the techniques described herein also may be used for generating and displaying one or more different types of notifications, transmitting a request for assistance to a service center computing device, and the like.

Input/Output (I/O) 109 may include a microphone, keypad, touch screen, and/or stylus through which a user of the breakdown detection computing device 101 may provide input, and may also include one or more of a speaker for providing audio output and a video display device for providing textual, audiovisual and/or graphical output. Software may be stored within memory 115 and/or storage to provide instructions to processor 103 for enabling device 101 to perform various actions. For example, memory 115 may store software used by the device 101, such as an operating system 117, application programs 119, and an associated internal database 121. The various hardware memory units in memory 115 may include volatile and nonvolatile, removable and non-removable media implemented in any method or technology for storage of information such as computer-readable instructions, data structures, program modules or other data. Certain devices and systems within breakdown detection systems may have minimum hardware requirements in order to support sufficient storage capacity, processing capacity, analysis capacity, network communication, etc. For instance, in some embodiments, one or more nonvolatile hardware memory units having a minimum size (e.g., at least 1 gigabyte (GB), 2 GB, 5 GB, etc.), and/or one or more volatile hardware memory units having a minimum size (e.g., 256 megabytes (MB), 512 MB, 1 GB, etc.) may be used in a device 101 (e.g., a personal mobile device 101, vehicle-based device 101, breakdown detection server 101, etc.), in order to receive and analyze the signals, transmissions, etc. including location information, vehicle operating information, and the like, determine a location of the vehicle, determine a cause of an issue associated with the vehicle, generate and transmit notifications, and the like, using the various devices of the breakdown detection systems. Memory 115 also may include one or more physical persistent memory devices and/or one or more non-persistent memory devices. Memory 115 may include, but is not limited to, random access memory (RAM) 105, read only memory (ROM) 107, electronically erasable programmable read only memory (EEPROM), flash memory or other memory technology, CD-ROM, digital versatile disks (DVD) or other optical disk storage, magnetic cassettes, magnetic tape, magnetic disk storage or other magnetic storage devices, or any other medium that can be used to store the desired information and that can be accessed by processor 103.

Processor 103 may include a single central processing unit (CPU), which may be a single-core or multi-core processor (e.g., dual-core, quad-core, etc.), or may include multiple CPUs. Processor(s) 103 may have various bit sizes (e.g., 16-bit, 32-bit, 64-bit, 96-bit, 128-bit, etc.) and various processor speeds (ranging from 100 MHz to 5 Ghz or faster). Processor(s) 103 and its associated components may allow the system 101 to execute a series of computer-readable instructions, for example, receive signals or transmissions including location information, vehicle operation information, scan for diagnostic codes, and the like, to determine a location of the vehicle, determine a cause of an issue associated with the vehicle, control amount and type of data received, and the like.

The computing device (e.g., a personal mobile device, vehicle-based system, insurance system server, breakdown detection server, etc.) may operate in a networked environment 100 supporting connections to one or more remote computers, such as terminals 141, 151, and 161. Such terminals may be personal computers or servers 141 (e.g., home computers, laptops, web servers, database servers), mobile communication devices 151 (e.g., mobile phones, tablet computers, etc.), vehicle-based computing systems 161 (e.g., on-board vehicle systems, telematics devices, mobile phones or other personal mobile devices within vehicles), and the like, each of which may include some or all of the elements described above with respect to the road segment evaluation computing device 101. The network connections depicted in FIG. 1 include a local area network (LAN) 125 and a wide area network (WAN) 129, and a wireless telecommunications network 133, but may also include other networks. When used in a LAN networking environment, the computing device 101 may be connected to the LAN 125 through a network interface or adapter 123. When used in a WAN networking environment, the device 101 may include a modem 127 or other means for establishing communications over the WAN 129, such as network 131 (e.g., the Internet). When used in a wireless telecommunications network 133, the device 101 may include one or more transceivers, digital signal processors, and additional circuitry and software for communicating with wireless computing devices 151 and 161 (e.g., mobile phones, portable customer computing devices, vehicle-based computing devices and systems, etc.) via one or more network devices 135 (e.g., base transceiver stations) in the wireless network 133.

Also illustrated in FIG. 1 is a security and integration layer 160, through which communications are sent and managed between the device 101 (e.g., a personal mobile device, a vehicle-based computing device, a breakdown detection server or computing platform, an intermediary server and/or external data source servers, etc.) and the remote devices (141, 151, and 161) and remote networks (125, 129, and 133). The security and integration layer 160 may comprise one or more separate computing devices, such as web servers, authentication servers, and/or various networking components (e.g., firewalls, routers, gateways, load balancers, etc.), having some or all of the elements described above with respect to the computing device 101. As an example, a security and integration layer 160 of a server 101 may comprise a set of web application servers configured to use secure protocols and to insulate the device 101 from external devices 141, 151, and 161. In some cases, the security and integration layer 160 may correspond to a set of dedicated hardware and/or software operating at the same physical location and under the control of same entities as device 101. For example, layer 160 may correspond to one or more dedicated web servers and network hardware in a vehicle and driver information datacenter or in a cloud infrastructure supporting cloud-based vehicle identification, location identification, vehicle operational parameters identification, issue detection, and the like. In other examples, the security and integration layer 160 may correspond to separate hardware and software components which may be operated at a separate physical location and/or by a separate entity.

As discussed below, the data transferred to and from various devices in a breakdown detection system 100 may include secure and sensitive data, such as confidential vehicle operation data, insurance policy data, and confidential user data from drivers and passengers in vehicles. Therefore, it may be desirable to protect transmissions of such data by using secure network protocols and encryption, and also to protect the integrity of the data when stored on the various devices within a system, such as personal mobile devices, vehicle-based devices, insurance servers, breakdown detection servers, external data source servers, or other computing devices in the system 100, by using the security and integration layer 160 to authenticate users and restrict access to unknown or unauthorized users. In various implementations, security and integration layer 160 may provide, for example, a file-based integration scheme or a service-based integration scheme for transmitting data between the various devices in an electronic display system 100. Data may be transmitted through the security and integration layer 160, using various network communication protocols. Secure data transmission protocols and/or encryption may be used in file transfers to protect the integrity of the data, for example, File Transfer Protocol (FTP), Secure File Transfer Protocol (SFTP), and/or Pretty Good Privacy (PGP) encryption. In other examples, one or more web services may be implemented within the various devices 101 in the system 100 and/or the security and integration layer 160. The web services may be accessed by authorized external devices and users to support input, extraction, and manipulation of the data (e.g., vehicle data, driver data, location data, breakdown issue data, etc.) between the various devices 101 in the system 100. Web services built to support a personalized display system may be cross-domain and/or cross-platform, and may be built for enterprise use. Such web services may be developed in accordance with various web service standards, such as the Web Service Interoperability (WS-I) guidelines. In some examples, a driver data, vehicle data, location data, breakdown issue data and/or breakdown data analysis web service, or the like, may be implemented in the security and integration layer 160 using the Secure Sockets Layer (SSL) or Transport Layer Security (TLS) protocol to provide secure connections between servers 101 and various clients 141, 151, and 161. SSL or TLS may use HTTP or HTTPS to provide authentication and confidentiality. In other examples, such web services may be implemented using the WS-Security standard, which provides for secure SOAP messages using XML encryption. In still other examples, the security and integration layer 160 may include specialized hardware for providing secure web services. For example, secure network appliances in the security and integration layer 160 may include built-in features such as hardware-accelerated SSL and HTTPS, WS-Security, and firewalls. Such specialized hardware may be installed and configured in the security and integration layer 160 in front of the web servers, so that any external devices may communicate directly with the specialized hardware.

Although not shown in FIG. 1, various elements within memory 115 or other components in system 100, may include one or more caches, for example, CPU caches used by the processing unit 103, page caches used by the operating system 117, disk caches of a hard drive, and/or database caches used to cache content from database 121. For embodiments including a CPU cache, the CPU cache may be used by one or more processors in the processing unit 103 to reduce memory latency and access time. In such examples, a processor 103 may retrieve data from or write data to the CPU cache rather than reading/writing to memory 115, which may improve the speed of these operations. In some examples, a database cache may be created in which certain data from a database 121 (e.g., a database of driver data, database of vehicle information, database of location information, database of breakdown issue information, etc.) is cached in a separate smaller database on an application server separate from the database server (e.g., at a personal mobile device, vehicle-based data, or intermediary network device or cache device, etc.). For instance, in a multi-tiered application, a database cache on an application server can reduce data retrieval and data manipulation time by not needing to communicate over a network with a back-end database server. These types of caches and others may be included in various embodiments, and may provide potential advantages in certain implementations of breakdown detection systems, such as faster response times and less dependence on network conditions when transmitting and receiving driver information, vehicle information, location information, breakdown detection issue information, and the like.

It will be appreciated that the network connections shown are illustrative and other means of establishing a communications link between the computers may be used. The existence of any of various network protocols such as TCP/IP, Ethernet, FTP, HTTP and the like, and of various wireless communication technologies such as GSM, CDMA, WiFi, and WiMAX, is presumed, and the various computing devices in breakdown detection system components described herein may be configured to communicate using any of these network protocols or technologies.

Additionally, one or more application programs 119 may be used by the various computing devices 101 within a breakdown detection system 100 (e.g., vehicle data, driver data, location data, breakdown detection issue data, and/or breakdown detection analysis software applications, etc.), including computer executable instructions for receiving and analyzing various signals or transmissions including location information, vehicle operating data, other vehicle operating data, and the like, determining a location of a vehicle, determining a cause of an issue, controlling an amount or type of data transmitted or received and the like.

Figure 2:
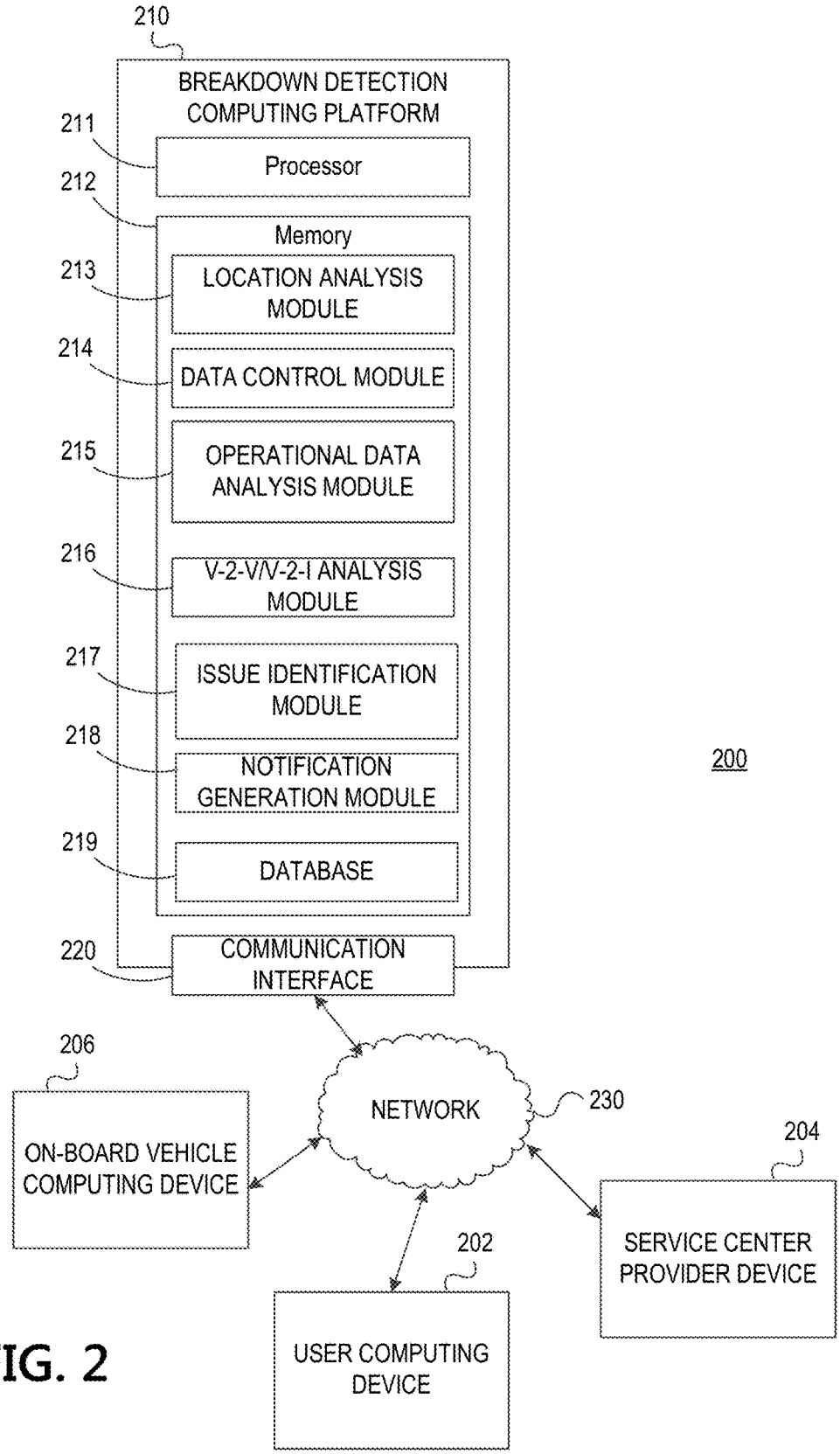
FIG. 2 illustrates one example breakdown detection system in accordance with one or more aspects described herein.

FIG. 2 depicts an environment 200 including an illustrative computing platform for determining a location of a vehicle, determining that the vehicle is stopped, identifying an issue causing the vehicle to stop, and generating and transmitting one or more notifications based on the determined issue, according to one or more aspects described herein. For instance, the environment 200 includes a breakdown detection computing platform 210, which may include one or more processors 211, memory 212, and communication interface 220. A data bus may interconnect processor(s) 211, memory 212, and communication interface 220. Communication interface 220 may be a network interface configured to support communication between breakdown detection computing platform 210 and one or more networks (e.g., network 230). One or more computing destinations 202, 204, 206 may be in communication with the breakdown detection computing platform 210 (e.g., via network 230). Memory 212 may include one or more program modules having instructions that when executed by processor(s) 111 cause breakdown detection computing platform 210 to perform one or more functions described herein and/or one or more databases that may store and/or otherwise maintain information which may be used by such program modules and/or processor(s) 211. In some instances, the one or more program modules and/or databases may be stored by and/or maintained in different memory units of breakdown detection computing platform 210 and/or by different computer systems that may form and/or otherwise make up the breakdown detection computing platform 210. In some arrangements, different features or processes performed may be performed by different sets of instructions, such that the processor may execute each desired set of instructions to perform different functions described herein.

For example, memory 212 may include a location analysis module 213. The location analysis module 213 may receive data (e.g., signals or other electronic transmissions), for example, in real-time, including location information of a vehicle. In some examples, the location data may be received from a user computing device 202, which may include, for example, a smartphone, cell phone, tablet computing device, or the like, associated with the user and currently located with or within the vehicle. Global positioning system (GPS) data may be received from the user computing device 202 and processed to determine a current location of the vehicle, which may aid in determining whether the vehicle is currently located on a highway.

In another example, GPS data may be received from one or more sensors located within the vehicle and transmitted via an on-board vehicle computing device 206. The data received may be processed to determine the current location of the vehicle.

Memory 212 may further include a data control module 214. Data control module 214 may be configured to control an amount or type of data collected by one or more sensors, transmitted to breakdown detection computing platform 210, or the like. For example, based on location analysis, vehicle operation data, and the like, the data control module 214 may increase or decrease (e.g., limit) an amount or type of data collected by one or more sensors (e.g., vehicle sensors, user computing device sensors, or the like). In some examples, the data control module 214 may determine an amount or type of data to be collected by the sensors or transmitted to the breakdown detection computing platform 210 and may transmit a command or instruction to a computing device associated with the sensors, such as on-board vehicle computing device 206, user computing device 202, or the like, controlling the amount or type of data collected. Accordingly, if a vehicle is determined to not be traveling on a highway, the data control module 214 may limit the amount of data transmitted to the breakdown detection computing platform 210 for processing to improve efficiency, conserve computing resources, and the like. Alternatively, if a vehicle is determined to be traveling on a highway, the data control module 214 may increase an amount or type of data collected by sensors and/or transmitted to the breakdown detection computing platform 210 to evaluate operational parameters of the vehicle, determine whether the vehicle is stopped, determine a cause or type of issue causing the vehicle to stop, and the like.

Memory 212 may further include an operational analysis data module 215. Operational analysis data module 215 may be configured to receive data (e.g., signals or other electronic transmissions), for example, in real-time, associated with operating parameters of the vehicle. For instance, data such as current speed, recent historical speeds, and the like, may be received by the operational analysis data module 215 and processed to evaluate operational parameters of the vehicle (e.g., to determine whether the vehicle is stopped). In some examples, data may be received from sensors in a user computing device 202. Additionally or alternatively, data may be received from one or more vehicle based sensors and transmitted via an on-board vehicle computing device 206, telematics device, or the like.

Memory 212 may further include vehicle-to-vehicle or vehicle-to-infrastructure data analysis module 216. The vehicle-to-vehicle or vehicle-to-infrastructure data analysis module 216 may be configured to receive data via short range vehicle-to-vehicle and/or vehicle-to-infrastructure communications to evaluate operating parameters of other vehicle at or near a location of the vehicle. For instance, the vehicle-to-vehicle or vehicle-to-infrastructure data analysis module 216 may receive data from one or more other vehicles, infrastructure, or the like, at or near a location of the vehicle being evaluated to determine whether the other vehicles are, for example, also stopped or are still moving and, if so, at what speed. This may aid in determining whether the vehicle being evaluated is stopped due to heavy traffic as opposed to being stopped because of an emergency, breakdown, or the like.

Memory 212 may further include issue identification module 217. Issue identification module 217 may be configured to receive data (e.g., signals or other electronic transmissions) to determine whether an issue with a vehicle has occurred and, if so, to determine whether the cause of the issue is an urgent situation reason or a non-urgent situation reason. For example, the issue identification module 217 may receive data indicating that a vehicle is stopped on a highway, that other traffic around the vehicle is still moving, and that the vehicle has not exited the highway. Accordingly, the issue identification module 217 may scan (e.g., in real-time) the diagnostic codes of the vehicle to determine whether one or more diagnostic codes have been activated. If so, the issue identification module 217 may determine that the vehicle is stopped for an urgent situation reason (e.g., low tire pressure, low fuel, low battery power, low oil level, or the like). If no diagnostic codes have been activated, in some examples, the issue identification module 217 may determine that the vehicle is stopped for a non-urgent situation reason (e.g., to place a phone call, to address an issue within the vehicle, or the like).

Memory 212 may further include a notification generation module 218. Notification generation module 218 may be configured to generate, transmit and/or cause to display one or more different types of notifications based on whether the vehicle is stopped for an urgent situation reason or a non-urgent situation reason. For instance, if the vehicle is stopped for an urgent situation reason (e.g., as determined by the issue identification module 217), a request for assistance may be transmitted to a service center computing device 204 and a notification may be generated and transmitted to the user computing device 202, on-board vehicle computing device 206, or the like, indicating that an issue has been detected and that a request for assistance has been sent. In some examples, the notification may include an estimated time of arrival of assistance. Accordingly, in at least some examples, if it is determined that the vehicle is stopped for an urgent situation reason, the breakdown detection computing platform 210 may automatically request roadside assistance for the vehicle (e.g., without additional user input).

If it is determined (e.g., by the issue determination module 217) that the vehicle is stopped for a non-urgent situation reason, a second type of notification may be generated and transmitted to a device. The second type of notification may be different from the first type of notification. For instance, the second type of notification may indicate that the system has recognized that the vehicle is stopped, may request user input confirming that there is no emergency or urgent situation, may provide information about a surrounding area, and the like.

The generated notifications may be transmitted to one or more computing devices, e.g., devices 202, 204, 206, via push notifications, short message service (SMS), via an application executing one or more devices 202, 204, 206, or the like. The breakdown detection computing platform 210 may cause the notifications to display on a display of the one or more computing devices 202, 204, 206.

Breakdown detection computing platform 210 may further include a database. The database may include or store information associated with the driver of the vehicle, the vehicle itself, insurance policy information, historical issues detected, and the like. This information may be used to aid in determining when an issue has occurred, what type of issue, and the like. For instance, historical data may indicate that that the vehicle has previously stopped in a same or similar location. Accordingly, this may indicate that the vehicle is stopped for a non-urgent situation reason.

Although the various modules of the breakdown detection computing platform 210 are described separately, functionality of the various modules may be combined and/or may be performed by a single device or multiple computing devices in communication without departing from the invention.

Figure 3:
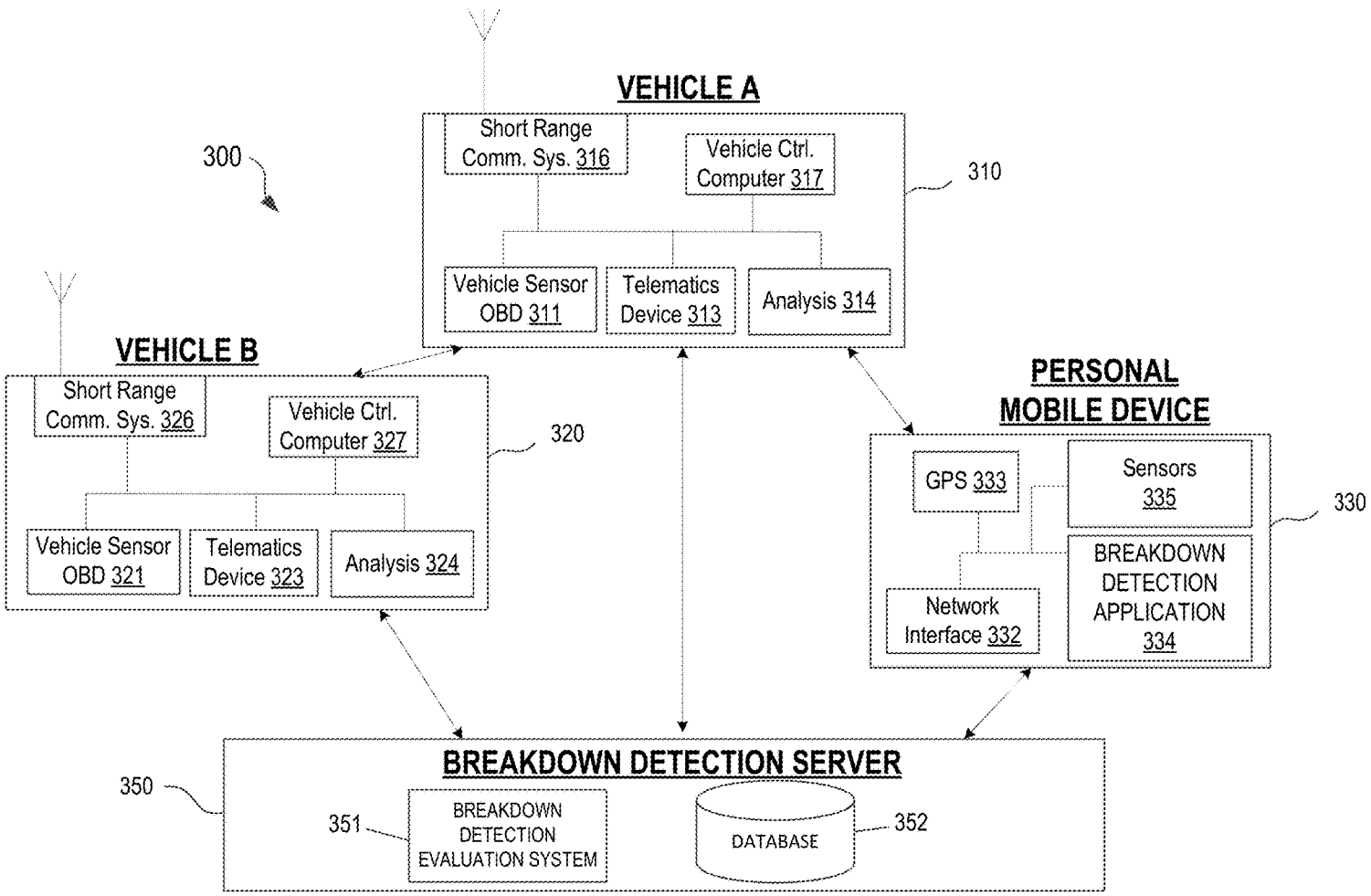
FIG. 3 is another example breakdown detection system in accordance with one or more aspects described herein.

FIG. 3 is a diagram of an illustrative breakdown detection system including additional aspects not shown in the breakdown detection system 200 of FIG. 2 and/or implementing the breakdown detection system 200 of FIG. 2. The system 300 includes a first vehicle 310 (e.g., the vehicle being evaluated for potential breakdown), a personal mobile device 330, a breakdown detection server 350, another vehicle 320, and additional related components. Although only one additional vehicle (e.g., Vehicle B 318) is shown in FIG. 3, more additional vehicles may be part of the system without departing from the invention. As discussed below, the components of the system 300, individually or using communication and collaborative interaction, may determine a location of Vehicle A 310, determine whether the vehicle has stopped, control an amount or type of data received and/or processed, determine whether the vehicle is stopped for an urgent situation reason or a non-urgent situation reason, and generate and transmit one or more notifications. To perform such functions, the components shown in FIG. 3 each may be implemented in hardware, software, or a combination of the two. Additionally, each component of the system 300 may include a computing device (or system) having some or all of the structural components described above for computing device 101.

Vehicle 310 in the system 300 may be, for example, an automobile, a motorcycle, a scooter, a bus, a recreational vehicle, a boat, or other vehicle for which vehicle data, location data, driver data (or operator data), operational data and/or other driving data (e.g., location data, time data, weather data, etc.) may be collected and/or analyzed. The vehicle 310 includes vehicle operation sensor 311 capable of detecting and recording various conditions at the vehicle and operational parameters of the vehicle. For example, sensor 311 may detect and store data corresponding to the vehicle's location (e.g., GPS coordinates), time, travel time, speed and direction, rates of acceleration or braking, gas mileage, and specific instances of sudden acceleration, braking, swerving, and distance traveled. Sensor 311 also may detect and store data received from the vehicle's 310 internal systems, such as impact to the body of the vehicle, air bag deployment, headlights usage, brake light operation, door opening and closing, door locking and unlocking, cruise control usage, hazard lights usage, windshield wiper usage, horn usage, turn signal usage, seat belt usage, phone and radio usage within the vehicle, autonomous driving system usage, maintenance performed on the vehicle, and other data collected by the vehicle's computer systems, including the vehicle on-board diagnostic systems (OBD).

Additional sensors 311 may detect and store the external driving conditions, for example, external temperature, rain, snow, light levels, and sun position for driver visibility. For example, external cameras and proximity sensors 311 may detect other nearby vehicles, vehicle spacing, traffic levels, road conditions, traffic obstructions, animals, cyclists, pedestrians, and other conditions that may factor into a breakdown detection analysis. Sensor 311 also may detect and store data relating to moving violations and the observance of traffic signals and signs by the vehicle 310. Additional sensors 311 may detect and store data relating to the maintenance of the vehicle 310, such as the engine status, oil level, engine coolant temperature, odometer reading, the level of fuel in the fuel tank, engine revolutions per minute (RPMs), software upgrades, and/or tire pressure.

Vehicles sensor 311 also may include cameras and/or proximity sensors capable of recording additional conditions inside or outside of the vehicle 310. For example, internal cameras may detect conditions such as the number of the passengers and the types of passengers (e.g. adults, children, teenagers, pets, etc.) in the vehicles, and potential sources of driver distraction within the vehicle (e.g., pets, phone usage, and unsecured objects in the vehicle). Sensor 311 also may be configured to collect data identifying a current driver from among a number of different possible drivers, for example, based on driver's seat and mirror positioning, driving times and routes, radio usage, etc. Voice/sound data along with directional data also may be used to determine a seating position within a vehicle 310. Sensor 311 also may be configured to collect data relating to a driver's movements or the condition of a driver. For example, vehicle 310 may include sensors that monitor a driver's movements, such as the driver's eye position and/or head position, etc. Additional sensors 311 may collect data regarding the physical or mental state of the driver, such as fatigue or intoxication. The condition of the driver may be determined through the movements of the driver or through other sensors, for example, sensors that detect the content of alcohol in the air or blood alcohol content of the driver, such as a breathalyzer, along with other biometric sensors.

Certain vehicle sensors 311 also may collect information regarding the driver's route choice, whether the driver follows a given route, and to classify the type of trip (e.g. commute, errand, new route, etc.) and type of driving (e.g., continuous driving, parking, stop-and-go traffic, etc.). In certain embodiments, sensors and/or cameras 311 may determine when and how often the vehicle 310 stays in a single lane or strays into other lane. A Global Positioning System (GPS), locational sensors positioned inside the vehicle 310, and/or locational sensors or devices external to the vehicle 310 may be used to determine the route, speed, lane position, road-type (e.g. highway, entrance/exit ramp, residential area, etc.) and other vehicle position/location data.

The data collected by vehicle sensor 311 may be stored and/or analyzed within the vehicle 310, such as for example by a breakdown analysis computer 314 integrated into the vehicle, and/or may be transmitted to one or more external devices. For example, as shown in FIG. 3, sensor data may be transmitted via a telematics device 313 to one or more remote computing devices, such as personal mobile device 330, breakdown detection server 350, and/or other remote devices.

As shown in FIG. 3, the data collected by vehicle sensor 311 may be transmitted to breakdown detection server 350, personal mobile device 330, and/or additional external servers and devices via telematics device 313. Telematics device 313 may be one or more computing devices containing many or all of the hardware/software components as the computing device 101 depicted in FIG. 1. As discussed above, the telematics device 313 may receive vehicle operation data and driving data from vehicle sensor 311, and may transmit the data to one or more external computer systems (e.g., breakdown detection server 350 of an insurance provider, financial institution, or other entity) over a wireless transmission network. Telematics device 313 also may be configured to detect or determine additional types of data relating to real-time driving and the condition of the vehicle 310. The telematics device 313 also may store the type of vehicle 310, for example, the make, model, trim (or submodel), year, and/or engine specifications, as well as other information such as vehicle owner or driver information, insurance information, and financing information for the vehicle 310.

In the example shown in FIG. 3, telematics device 313 may receive vehicle driving data from vehicle sensor 311, and may transmit the data to a breakdown detection server 350. However, in other examples, one or more of the vehicle sensors 311 or systems may be configured to receive and transmit data directly from or to a breakdown detection server 350 without using a telematics device. For instance, telematics device 313 may be configured to receive and transmit data from certain vehicle sensors 311 or systems, while other sensors or systems may be configured to directly receive and/or transmit data to a breakdown detection server 350 without using the telematics device 313. Thus, telematics device 313 may be optional in certain embodiments.

In some examples, telematics, sensor data, and/or other data (e.g., error or issue codes associated with maintenance of a vehicle) may be transmitted (e.g., to breakdown detection server) and may be used to further aid in identifying an issue or type of issue a vehicle may be having.

Breakdown detection system 300 may include one or more other or additional vehicles, such as Vehicle B 320. Vehicle B may include a vehicle control computer 327, vehicle sensors 321, telematics device 323, and data analysis system 324. These systems, devices or components may operate and/or perform functions similar to counterpart devices and components described with respect to Vehicle A 310.

Vehicle A 310 and Vehicle B 320 may further include a short-range communication systems 316 and 326. The short-range communication systems 316 and 326 may be vehicle-based data transmission systems configured to transmit vehicle operational data to other nearby vehicles, and to receive vehicle operational data from other nearby vehicles. In some examples, communication systems 316 and 326 may use the dedicated short-range communications (DSRC) protocols and standards to perform wireless communications between vehicles. In the United States, 75 MHz in the 5.850-5.925 GHz band have been allocated for DSRC systems and applications, and various other DSRC allocations have been defined in other countries and jurisdictions. However, short-range communication systems 316 and 326 need not use DSRC, and may be implemented using other short-range wireless protocols in other examples, such as WLAN communication protocols (e.g., IEEE 802.11), Bluetooth (e.g., IEEE 802.15.1), or one or more of the Communication Access for Land Mobiles (CALM) wireless communication protocols and air interfaces. The vehicle-to-vehicle (V2V) transmissions between the short-range communication systems 316 and 326 may be sent via DSRC, Bluetooth, satellite, GSM infrared, IEEE 802.11, WiMAX, RFID, and/or any suitable wireless communication media, standards, and protocols. In certain systems, short-range communication systems 316 and 326 may include specialized hardware installed in vehicles 310 (e.g., transceivers, antennas, etc.), while in other examples the communication system 316 may be implemented using existing vehicle hardware components (e.g., radio and satellite equipment, navigation computers) or may be implemented by software running on the mobile device 330 of drivers and passengers within the vehicles 310, 320.

The range of V2V communications between vehicle communication systems 316 and 326 may depend on the wireless communication standards and protocols used, the transmission/reception hardware (e.g., transceivers, power sources, antennas), and other factors. Short-range V2V communications may range from just a few feet to many miles, and different types of driving behaviors, vehicle operational parameters, and the like, may be determined depending on the range of the V2V communications.

V2V communications also may include vehicle-to-infrastructure (V2I) communications, such as transmissions to or from vehicles to or from non-vehicle receiving devices, such as infrastructure. For example, infrastructure may include one or more of toll booths, rail road crossings, parking garages, road segments, parking lots, buildings or other structures, and/or road-side traffic monitoring devices which may include one or more sensors for detecting environmental conditions (e.g., weather, lighting, etc.) as well as parking availability. Certain V2V communication systems may periodically broadcast data from a vehicle 310 to any other vehicle 320, or other infrastructure device capable of receiving the communication, within the range of the vehicle's transmission capabilities. For example, a vehicle 310 may periodically broadcast (e.g., every 0.1 second, every 0.5 seconds, every second, every 5 seconds, etc.) certain vehicle operation data via its short-range communication system 316, regardless of whether or not any other vehicles or reception devices are in range. In other examples, a vehicle communication system 316 may first detect nearby vehicles and receiving devices, and may initialize communication with each by performing a handshaking transaction before beginning to transmit its vehicle operation data to the other vehicles and/or devices.

Broadcasts from infrastructure may also have varying ranges and, in some examples, infrastructure may broadcast to an intermediate station which may then relay the information to the breakdown detection server 350 (or other device).

The types of vehicle operational data, vehicle driving data, breakdown issue data, or the like, transmitted to or from vehicles 310 and/or 320 and/or infrastructure may depend on the protocols and standards used for the V2V or V2I communication, the range of communications, and other factors. In certain examples, vehicles 310 and 320 may periodically broadcast corresponding sets of similar vehicle driving data, such as the location (which may include an absolute location in GPS coordinates or other coordinate systems, and/or a relative location with respect to another vehicle or a fixed point), speed, and direction of travel. In certain examples, the nodes in a V2V (or V2I) communication system (e.g., vehicles and other reception devices) may use internal clocks with synchronized time signals, and may send transmission times within V2V (or V2I) communications, so that the receiver may calculate its distance from the transmitting node based on the difference between the transmission time and the reception time. The state or usage of the vehicle's controls and instruments may also be transmitted, for example, whether the vehicle is accelerating, braking, turning, and by how much, and/or which of the vehicle's instruments are currently activated by the driver (e.g., head lights, turn signals, hazard lights, cruise control, 4-wheel drive, traction control, etc.). Vehicle warnings such as a detection by the vehicle's internal systems that the vehicle is skidding, that an impact has occurred, or that the vehicle's airbags have been deployed, that a vehicle has stopped unexpectedly, also may be transmitted in V2V (or V2I) communications.

In various other examples, any data collected by any vehicle sensors 311 and 321 potentially may be transmitted via V2V or V2I communication to other nearby vehicles or infrastructure devices receiving V2V or V2I communications from communication systems 316, 326. Further, additional vehicle driving data not from the vehicle's sensors (e.g., vehicle make/model/year information, driver insurance information, driving route information, vehicle maintenance information, driver scores, etc.) may be collected from other data sources, such as a driver's or passenger's mobile device 330, and transmitted using V2V or V2I communications to nearby vehicles and other receiving devices using communication systems 316, 326.

The system 300 in FIG. 3 also includes a mobile device 330. Mobile device 330 may be, for example, a smartphone or other mobile phone, personal digital assistant (PDAs), tablet computer, and the like, and may include some or all of the elements described above with respect to the computing device 101. As shown in this example, some mobile devices in systems 300 (e.g., mobile device 330) may be configured to establish communication sessions with vehicle-based devices and various internal components of vehicle 310 via wireless networks or wired connections (e.g., for docked devices), whereby such mobile devices 330 may have secure access to internal vehicle sensors 311 and other vehicle-based systems. However, in other examples, the mobile device 330 might not connect to vehicle-based computing devices and internal components, but may operate independently by communicating with vehicle 310 via their standard communication interfaces (e.g., telematics device 313, etc.), or might not connect at all to vehicle 310.

Mobile device 330 may include a network interface 332, which may include various network interface hardware (e.g., adapters, modems, wireless transceivers, etc.) and software components to enable mobile device 330 to communicate with breakdown detection server 350, vehicle 310, and various other external computing devices. One or more specialized software applications, such as a breakdown detection application 334 may be stored in the memory of the mobile device 330. The breakdown detection application 334 may be received (e.g., downloaded or otherwise provided) via network interface 332 from the breakdown detection server 350, vehicle 310, or other application providers (e.g., application stores). As discussed below, the breakdown detection application 334 may or may not include various user interface screens, and may be configured to run as user-initiated applications or as background applications. The memory of the mobile device 330 also may include databases configured to receive and store vehicle data, driving data, driving trip data, and the like, associated with one or more drivers, vehicles, and the like.

Mobile device 330 may include various components configured to generate and/or receive vehicle data, driver data, and driving data or other operational data, as well as communicate with other devices within the system 300. As discussed herein, the breakdown detection software application 334 may store and analyze the data from various mobile device components, historical data, and the like, and may use this data, in conjunction with one or more other devices (e.g., breakdown detection server 350), to identify a location of a vehicle, determine operational parameters of a vehicle, identify a potential issue or type of issue, generate, transmit or receive notifications, and the like.

Mobile computing device 330 may store, analyze, and/or transmit the data to one or more other devices. For example, mobile computing device 330 may transmit data directly to one or more breakdown detection servers 350. As discussed above, the breakdown detection server 350 may determine a location of the vehicle being evaluated, control data collected or received and processed by the system, determine operational parameters of the vehicle, identify one or more issues or types of issues, and generate and transmit notifications. In some examples, one or more of these functions may be performed by the processing components of the mobile device (e.g., via breakdown detection application 334). Therefore, in certain arrangements, mobile computing device 330 may be used in conjunction with, or in place of, the breakdown detection server 350.

Vehicle 310 may include breakdown detection analysis computer 314, which may be a separate computing device or may be integrated into one or more other components within the vehicle 310, such as the telematics device 313, autonomous driving systems, or the internal computing systems of vehicle 310. As discussed above, breakdown detection analysis computer 314 also may be implemented by computing devices independent from the vehicle 310, such as mobile computing device 330 of the drivers or passengers, or one or more separate computer systems (e.g., a user's home or office computer). In any of these examples, the breakdown detection analysis computer 314 may contain some or all of the hardware/software components as the computing device 101 depicted in FIG. 1. Further, in certain implementations, the functionality of the breakdown detection analysis computers, such as storing and analyzing driver data, vehicle data, location data, and the like, may be performed in a central breakdown detection server 350 rather than by the individual vehicle 310 or personal mobile device 330. In such implementations, the vehicle 310 and and/or mobile device 330, might only collect and transmit driver data, sensor data, location data, vehicle operational data, and the like to breakdown detection server 350, and thus the vehicle-based breakdown detection analysis computer 314 may be optional.

The system 300 also may include one or more breakdown detection servers 350, containing some or all of the hardware/software components as the computing device 101 depicted in FIG. 1. The breakdown detection server 350 may include hardware, software, and network components to receive data (e.g., signals or other electronic transmissions) related to location, operational data, and the like, process the data, control an amount or type of data collected by sensors and/or transmitted for processing or analysis, identify an issue or type of issue associated with a vehicle, generate and transmit notifications, and the like, from one or more vehicles 310, mobile devices 330, and other data sources. The breakdown detection server 350 may include a breakdown detection database 352 and breakdown detection evaluation system 351 to respectively store and analyze driver data, vehicle data, sensor data, etc., received from vehicle 310, mobile device 330, and/or other data sources. In some examples, the breakdown detection evaluation system 351 may include many or all of the components of the breakdown detection computing platform 210 described with respect to FIG. 2.

In some examples, some data may be received by the breakdown detection server 350 from vehicle 310 wirelessly via telematics device 313. Additionally, the breakdown detection server 350 may receive additional data from other third-party data sources, such as external traffic databases containing traffic data (e.g., amounts of traffic, average driving speed, traffic speed distribution, and numbers and types of accidents, etc.) at various times and locations, external weather databases containing weather data (e.g., rain, snow, sleet, and hail amounts, temperatures, wind, road conditions, visibility, etc.) at various times and locations, and other external data sources containing driving hazard data (e.g., road hazards, traffic accidents, downed trees, power outages, road construction zones, school zones, and natural disasters, etc.), route and navigation information, and insurance company databases containing insurance data (e.g., coverage amount, deductible amount, premium amount, insured status) for the vehicle, driver, and/or other nearby vehicles and drivers, and the like.

Data stored in the breakdown detection database 352 may be organized in any of several different manners. For example, a breakdown detection table may contain data related to previous roadside assistance issues, vehicle features (e.g., organized by make, model, year, etc.), special equipment needs for particular vehicles, images of roadside assistance issues, etc. Other tables in the database 352 may store additional data, including data types discussed above (e.g. traffic information, road-type and road condition information, weather data, insurance policy data, etc.). Additionally, one or more other databases of other insurance providers containing additional driver data and vehicle data may be accessed to retrieve such additional data.

The breakdown detection evaluation system 351 within the breakdown detection server 350 may be configured to retrieve data from the database 352, or may receive data directly from mobile device 330, or other data sources, and may perform one or more analyses to evaluate the data received, determine a location of the vehicle, determine whether the vehicle has stopped, control an amount or type of data collected or transmitted for processing, identify an issue or type of issue, generate and transmit notifications, and other related functions. The functions performed by the breakdown detection evaluation system 351 may be performed by specialized hardware and/or software separate from the additional functionality of the breakdown detection server 350. Such functions and further descriptions and examples of the algorithms, functions, and analyses that may be executed by the breakdown detection evaluation system 351 are described herein.

In various examples, the breakdown detection analyses, identifications and determinations may be performed entirely in the breakdown detection server 350, may be performed entirely in the vehicle-based breakdown detection analysis computing module 314, or may be performed entirely in the breakdown detection application 334 of mobile device 330. In other examples, certain analyses of data, and the like, may be performed by vehicle-based devices (e.g., within breakdown detection analysis device 314) or mobile device 330 (e.g., within application 334), while other data analyses are performed by the breakdown detection evaluation system 351 at the breakdown detection server 350. Various other combinations of devices processing data may be used without departing from the invention.

Figure 4A:
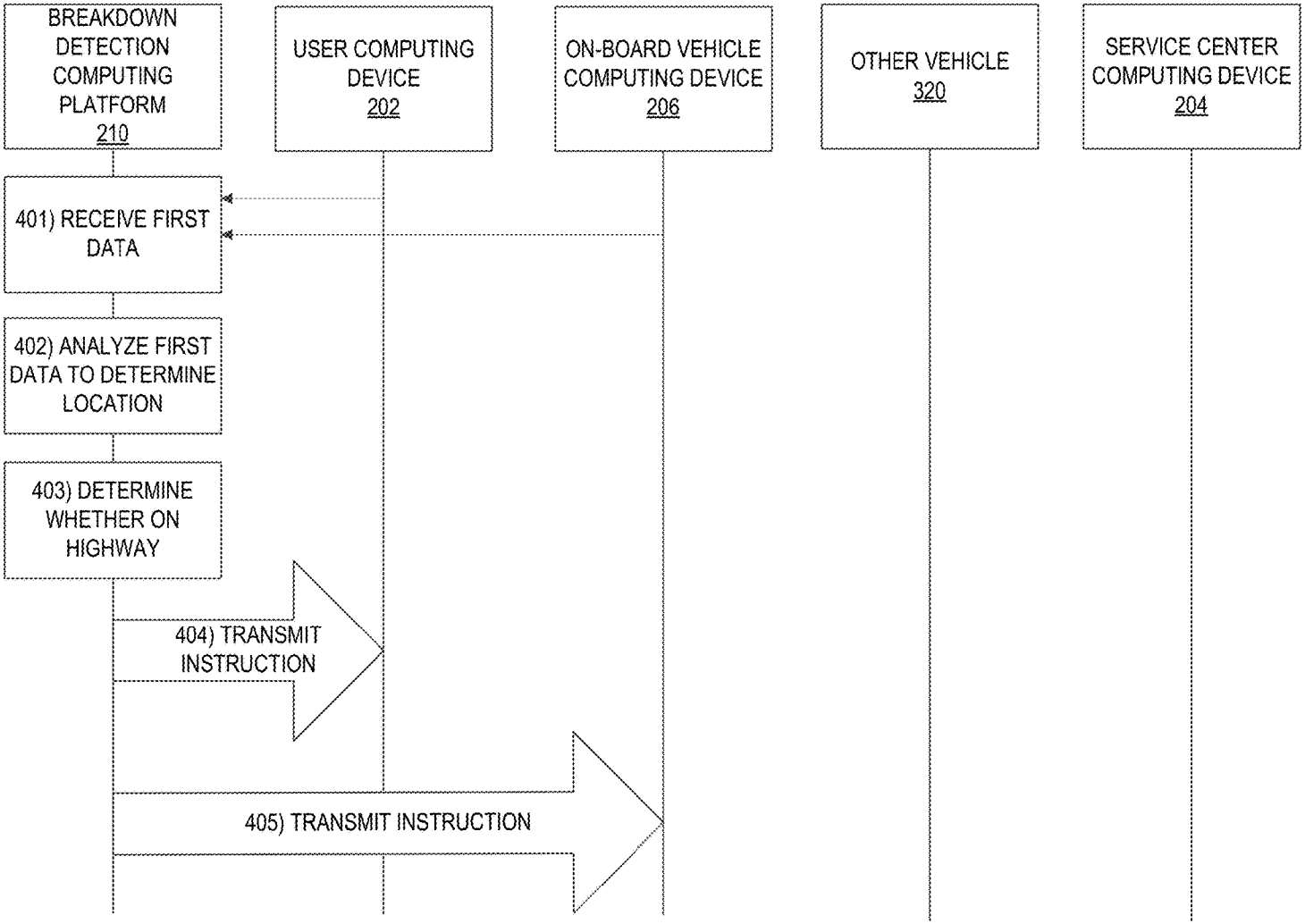
FIGS. 4A-4C illustrate one example event sequence in accordance with one or more aspects described herein.
Figure 4B:
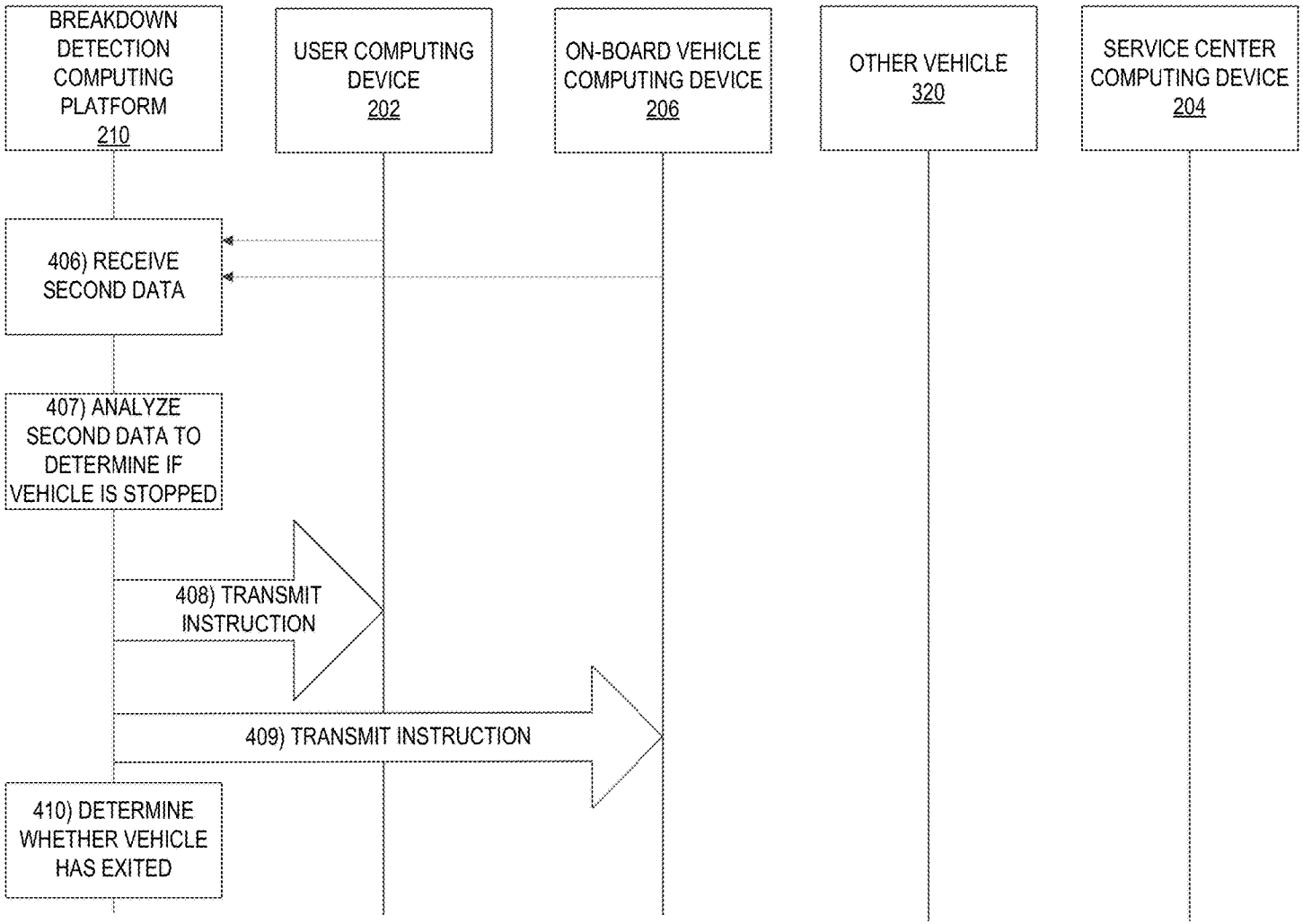
Figure 4C:
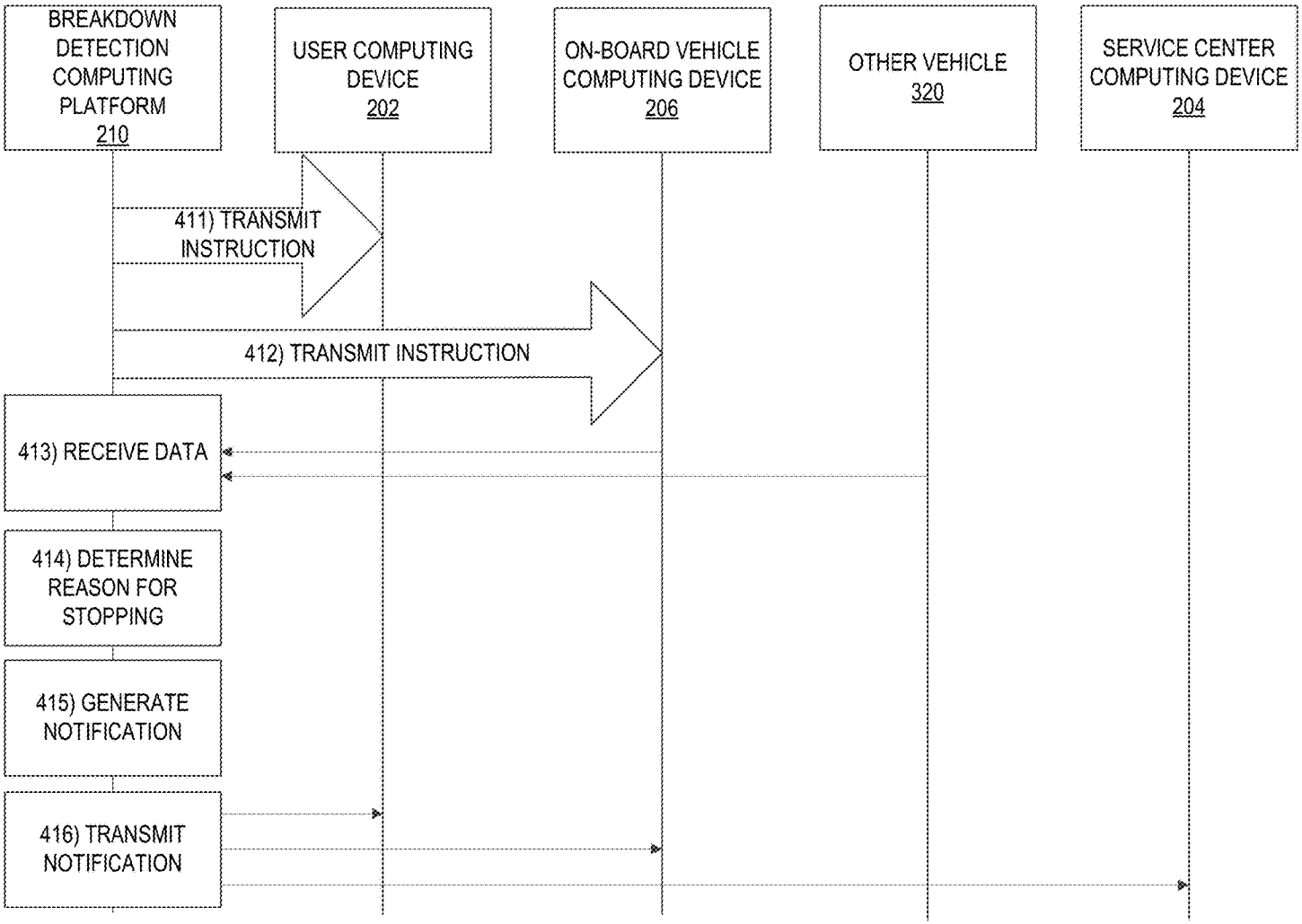

FIGS. 4A-4C illustrate one example event sequence for determining a location of a vehicle, determining whether the vehicle is having an urgent situation issue or a non-urgent situation issue and generating and transmitting notifications according to one or more aspects described herein. The sequence illustrated in FIGS. 4A-4C is merely one example sequence and various other events may be included, or events shown may be omitted, without departing from the invention. Further, one or more processes shown and/or described with respect to FIGS. 4A-4C may be performed in real-time or near real-time.

With reference to FIG. 4A, in step 401, data may be received from one or more sensors in a user computing device 202 within a vehicle and/or from on-board vehicle computing device 206 which may have or be in communication with one or more sensors 311 within the vehicle being evaluated. The data received may include signals or other electronic transmissions including location data, such as GPS data. In step 402, the received first data may be analyzed to determine a location of the vehicle (e.g., based on the GPS data from the user computing device 202 and/or the on-board vehicle computing device 206).

In step 403, the system may determine whether the determined location is on a highway. For example, the breakdown detection computing platform 210 may determine whether the determined location is within a predetermined distance (e.g., 10 feet, 100 feet, or the like) of a highway. In some examples, this determination may be made by comparing the received GPS data with known map data (e.g., retrieved from database 219).

Based on the determination made in step 403, one or more instructions or commands controlling an amount or type of data collected by sensors (e.g., in user computing device 202 or sensors 311 in vehicle) may be transmitted. For instance, if, in step 402, it is determined that the vehicle is on a highway, the breakdown detection computing platform 210 may transmit a signal increasing an amount or type of data collected by sensors (e.g., in user computing device 202 or on-board vehicle computing device 206) to enable the breakdown detection computing platform 210 to accurately evaluate operational parameters of the vehicle, detect potential issues, evaluate potential issues, and the like. Accordingly, in some examples, the breakdown detection computing platform may transmit an instruction to the user computing device 202 in step 404 and/or the on-board vehicle computing device 206 in step 405 to modify an amount or type of data collected and/or transmitted. In some examples, modifying the amount or type of data may include increasing the amount or type of data from a baseline amount or type of data (e.g., GPS data at certain predefined time periods or intervals). Accordingly, upon receiving the instruction, the user computing device 202 and/or on-board vehicle computing device 206 may collect additional amounts of data (e.g., data at more frequent intervals) and/or additional types of data (e.g., vehicle operating parameters, vehicle-to-vehicle (V2V) data received by vehicle computing device 206, and the like.

In another example, if the determined location is not on a highway, the breakdown detection computing platform 210 may transmit an instruction or command (e.g., in steps 404 and/or 405) to modify an amount or type of data collected by sensors (e.g., in user computing device 202 or on-board vehicle computing device 206) and/or transmitted for processing. For instance, if the vehicle is not on a highway, the breakdown detection computing platform 210 may reserve computing resources, data transmission bandwidth, and the like, by limiting or throttling the amount or type of data collected and/or transmitted for processing. For instance, data may be collected at longer intervals, fewer types of data may be collected, or the like.

The instructions transmitted in steps 404 and 405 may cause the user computing device 202 and/or on-board vehicle computing device 206 to modify data collection and/or transmission based on the instruction received.

With reference to FIG. 4B, in step 406, if the location of the vehicle is determined to be on a highway, second data may be transmitted to and received by the breakdown detection computing platform 210. For instance, additional amounts or types of data may be transmitted from user computing device 202, on-board vehicle computing device 206, or the like. The data may include signals or other electronic transmissions associated with one or more operational parameters of the vehicle, such as a speed of the vehicle.

In step 407, the received second data may be analyzed to determine whether the vehicle is stopped. If the vehicle is not stopped, the breakdown detection computing platform 210 may transmit an instruction to the user computing device 202 in step 408 and/or the on-board vehicle computing device 206 in step 409 to continue collecting and transmitting the modified amount or type of data. Alternatively, if, in step 407, analysis of the received data indicates that the vehicle is stopped, the breakdown detection computing platform may determine whether the vehicle has exited the highway (e.g., that the vehicle is no longer within the predetermined distance of the highway) in step 410 (e.g., based on updated GPS information received in, for example, the second data or modified amount or type of data).

With reference to FIG. 4C, in step 410, if the vehicle has exited the highway, the breakdown detection computing platform 210 may generate and transmit an instruction or command causing the user computing device (in step 411) and/or the on-board vehicle computing device 206 (in step 412) to modify an amount or type of data collected and/or transmitted to the breakdown detection computing platform 210 for processing. For instance, the amount of data may have been increased when the vehicle was determined to be on the highway but the vehicle has exited to the amount or type of data may be reduced (e.g., to another modified amount or type, to a baseline amount or type, to a previous amount or type, or the like).

If, in step 410, it is determined that the vehicle has not exited the highway, the breakdown detection computing platform 210 may request data from one or more other vehicles, such as from a computing device in other vehicle 320. For example, data may be received via V2V communications (e.g., by the on-board vehicle computing device 206 of the vehicle being evaluated). This data may be received from one or more other vehicles at or near the determined location of the vehicle being evaluated. Accordingly, that data may be transmitted to and received by the breakdown detection computing platform in step 413. In some examples, the V2V data may be transmitted first to on-board vehicle computing device 206 (e.g., via V2V communications) and then may be transmitted to the breakdown detection computing platform 210 (e.g., via wireless or other communication protocols).

In step 414, the breakdown detection computing platform 210 may determine a cause or reason for the vehicle being stopped. For example, the breakdown detection computing platform 210 may determine whether the vehicle is stopped for an urgent situation reason (e.g., flat tire, out of gas, mechanical issue, etc.) or a non-urgent situation reason (e.g., missed exit, looking for information about area, or the like). In some examples, the breakdown detection computing platform 210 may scan the on-board vehicle computing device 206 to determine whether one or more diagnostic codes have been activated. If so, the computing platform 210 may determine that the vehicle is stopped for an urgent situation reason. If no diagnostic codes are activated, the computing platform may determine that the vehicle is stopped for a non-urgent situation reason.

In another example, the breakdown detection computing platform 210 may evaluate the data received from other vehicles (e.g., in step 413) to determine whether those vehicles are also stopped (e.g., due to traffic, accident in the area, etc.). If other vehicles are also stopped, the computing platform 210 may determine that the vehicle is stopped for a non-urgent situation reason. If the other vehicles are still moving (e.g., are moving a predetermined threshold amount faster than the vehicle being evaluated) the breakdown detection computing platform 210 may determine that the vehicle is stopped for an urgent situation reason.

In step 415, a notification may be generated. In some examples, the type of notification generated may be based on whether the vehicle is determined to be stopped for an urgent situation reason or a non-urgent situation reason. In some examples, a first type of notification may be generated if the vehicle is stopped for an urgent situation reason. Further, if the vehicle is stopped for an urgent situation reason, a notification and request for assistance may be transmitted to a service center computing device 204 in step 416. The request may include a location of the vehicle, a description of the issue, and the like. Additionally, the breakdown detection computing platform 210 may generate a notification that is transmitted to a user computing device 202 and/or a display of the on-board vehicle computing device 206. The notification may include an indication that an issue has been detected and that assistance has been requested. The notification may further include an estimated time of arrival of assistance, as well as an option for the user to provide feedback or input (e.g., decline the requested assistance, request additional assistance, or the like).

If the vehicle is stopped for a non-urgent situation reason, a second type of notification may be transmitted to the user. The second type of notification may be different from the first type. For example, the second type of notification may include an indication that the system has recognized the vehicle is stopped and may request user input if additional assistance is required. Additionally or alternatively, the second type of notification may include information about an area surrounding the location of the vehicle (e.g., local points of interest, food or lodging nearby, or the like). The second type of notification may be transmitted to the user computing device 202 and/or the on-board vehicle computing device 206 in step 416 (e.g., via push notification, SMS, or the like).

Figure 5A:
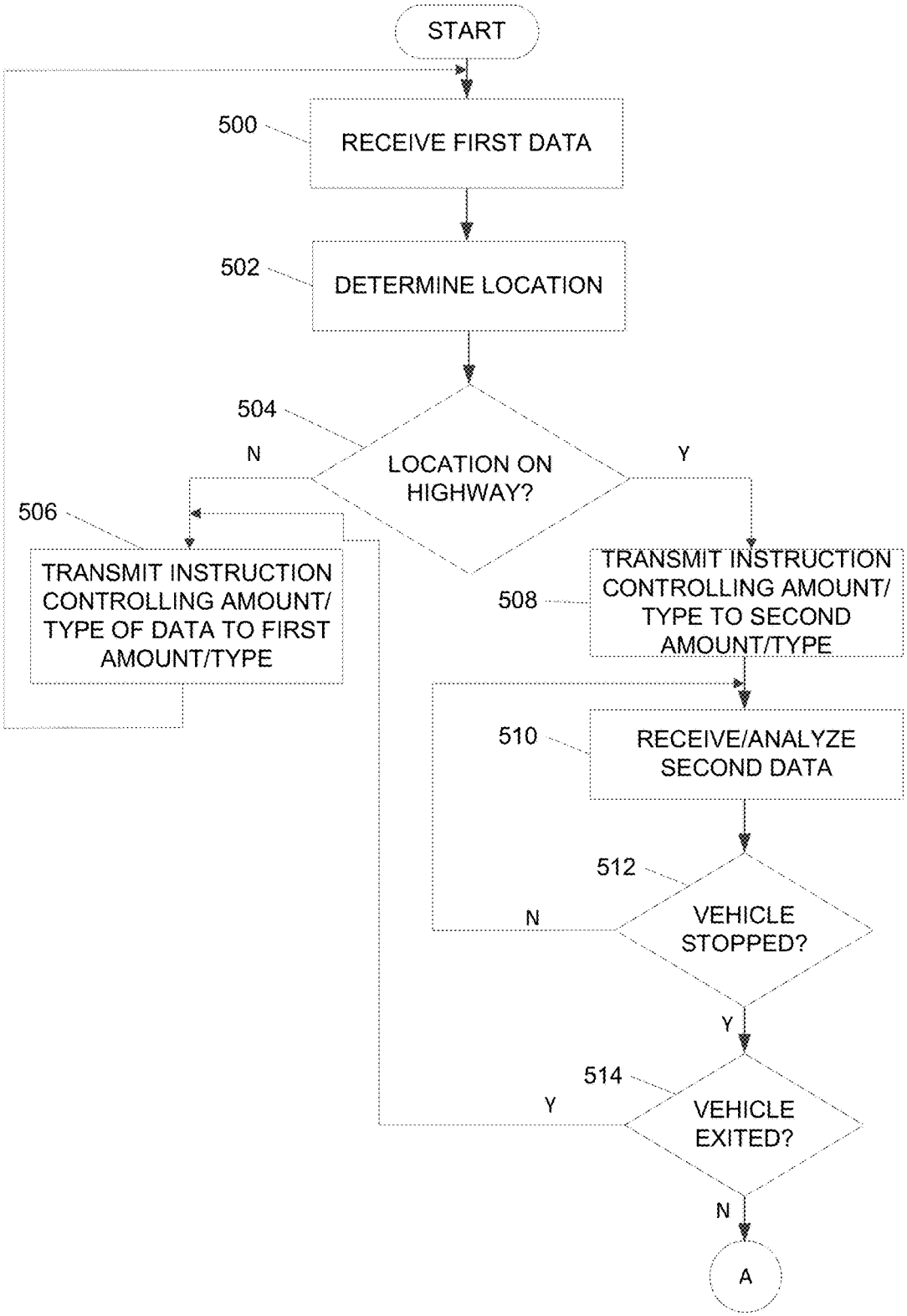
FIGS. 5A and 5B illustrate one example method of determining a location of a vehicle, detecting an issue with a vehicle, determining a type of issue and generating and transmitting a notification, in accordance with one or more aspects described herein.
Figure 5B:
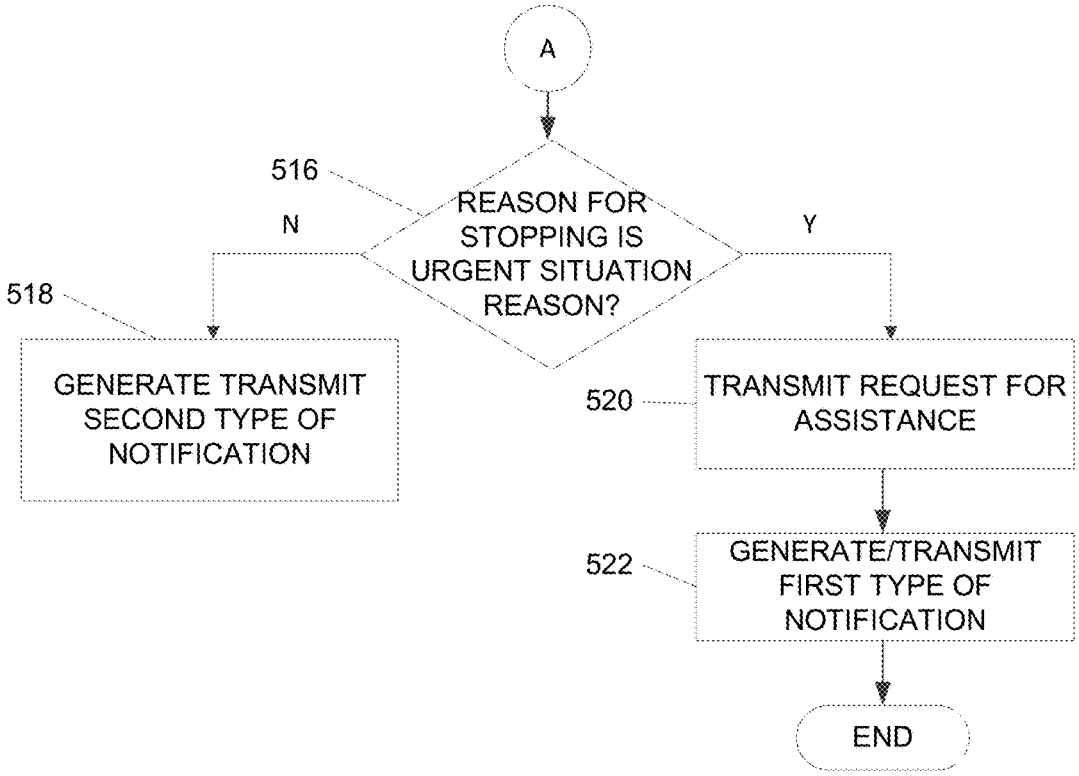

FIGS. 5A and 5B illustrate a flow chart illustrating one example method of determining a location of a vehicle, determining a type of issue associated with the vehicle and generating and transmitting one or more notifications in accordance with one or more aspects described herein. In step 500, first data may be received (e.g., by a breakdown detection computing platform 210). The first data may include location data, such as GPS data, from a GPS in a vehicle being evaluated or from a user computing device, such as a mobile device currently located within the vehicle or in a same location as the vehicle. In step 502, the received data may be analyzed to determine the current location of the vehicle.

In step 504, a determination may be made as to whether the determined current location is on a highway. If the current location is not on a highway, the breakdown detection computing platform may transmit an instruction to one or more computing devices (e.g., on-board vehicle computing device 206, user computing device 202, or the like) controlling or modifying an amount or type of data collected and/or transmitted to the computing platform 210 in step 506. In some examples, the instruction transmitted in step 506 may include an instruction to reduce or limit an amount or type of data collected and/or transmitted to improve efficiency, reduce computing resources, and the like. The process may then return to step 500 to receive updated location data and begin the process at an updated current location.

If, in step 504, the current location of the vehicle is determined to be on a highway, in step 508, the computing platform 210 may transmit an instruction to control or modify an amount or type of data. For instance, the computing platform 210 may transmit an instruction to the on-board vehicle computing device 206, user computing device 202, or the like, modifying a type or amount of data collected and/or transmitted for processing. In some examples, modifying the type or amount of data collected and/or transmitted for processing may include increasing an amount or type of data collected and/or transmitted to aid in accurately determining whether an issue has occurred, identifying a type of issue, and the like.

In step 510, additional or second data may be received and/or analyzed. The second data may include the increased amount or type of data (e.g., vehicle operational data, and the like). In step 512, the second data may be analyzed to determine whether the vehicle being evaluated is stopped. If not, the process may return to step 510 to receive and/or analyze additional data.

If, in step 512, it is determined that the vehicle is stopped (e.g., based on speed or other vehicle operational data received) a determination may be made in step 514 as to whether the vehicle has exited the highway (e.g., based on current GPS data provided, for example, as part of the received second data). If, in step 514, the vehicle has exited, the process may return to step 506 and an instruction to modify an amount or type of data collected and/or transmitted may be transmitted to one or more computing devices.

If, in step 514, the vehicle has not exited the highway, the process may continue at step 516 in FIG. 5B. At step 516, the breakdown detection computing platform 210 may determine whether the reason for stopping is an urgent situation reason or a non-urgent situation reason. In some examples, this determination may be based on a scan of diagnostic codes activated in the vehicle. Additionally or alternatively, the determination may be based on data received from other vehicles at a same or similar location (e.g., via V2V communications). The data received from other vehicles may include current speed data associated with the other vehicles.

If, in step 516, the reason for stopping is an urgent situation reason, a request for assistance (e.g., roadside assistance) may be transmitted to a service center computing device in step 520. In some examples, the request for assistance may be automatically transmitted (e.g., without additional user input). In step 522, a first type of notification may be generated and/or transmitted for display on one or more computing devices. In some examples, the first type of notification may include an indication that an issue is recognized, that a request for assistance has been placed, and the like.

Figure 6:
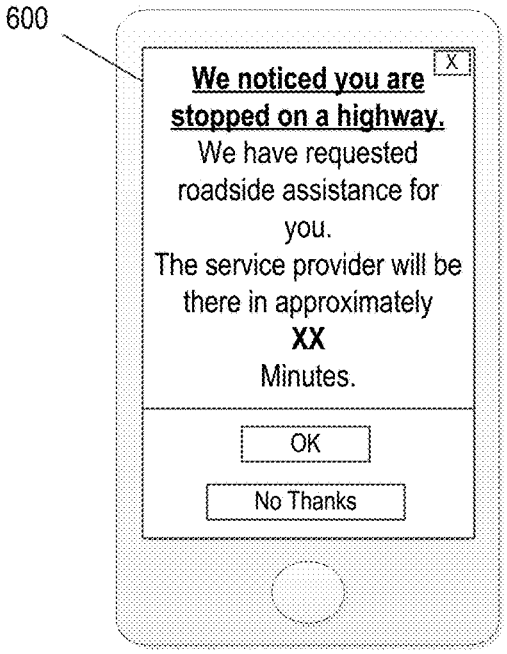
FIG. 6 illustrates one example user interface for providing a first type of notification to a display device in accordance with one or more aspects described herein.

FIG. 6 illustrates one example user interface including a notification of the first type. The interface 600 is one example of a first type of notification and additional or alternative information may be provided in a first notification without departing from the invention.

Interface 600 includes an indication that the system has recognized that an issue has occurred. In addition, the interface 600 includes an indication that a request for roadside assistance has been made and it includes an estimated time of arrival of the roadside assistance. If a user does not wish to accept the requested roadside assistance (e.g., can repair the issue themselves, has already requested assistance, or the like), the user may select "No Thanks" option and the system will transmit an instruction cancelling the requested roadside assistance.

With further reference to FIG. 5B, if, in step 516, the reason for stopping is a non-urgent situation reason (516: No) a second type of notification may be generated and transmitted for display on one or more computing devices, such as on-board vehicle computing device 206, user computing device 202, or the like. In some examples, the second type of notification may be different from the first type of notification (e.g., may include additional requests for user input, may include alternate information, or the like).

Figure 7:
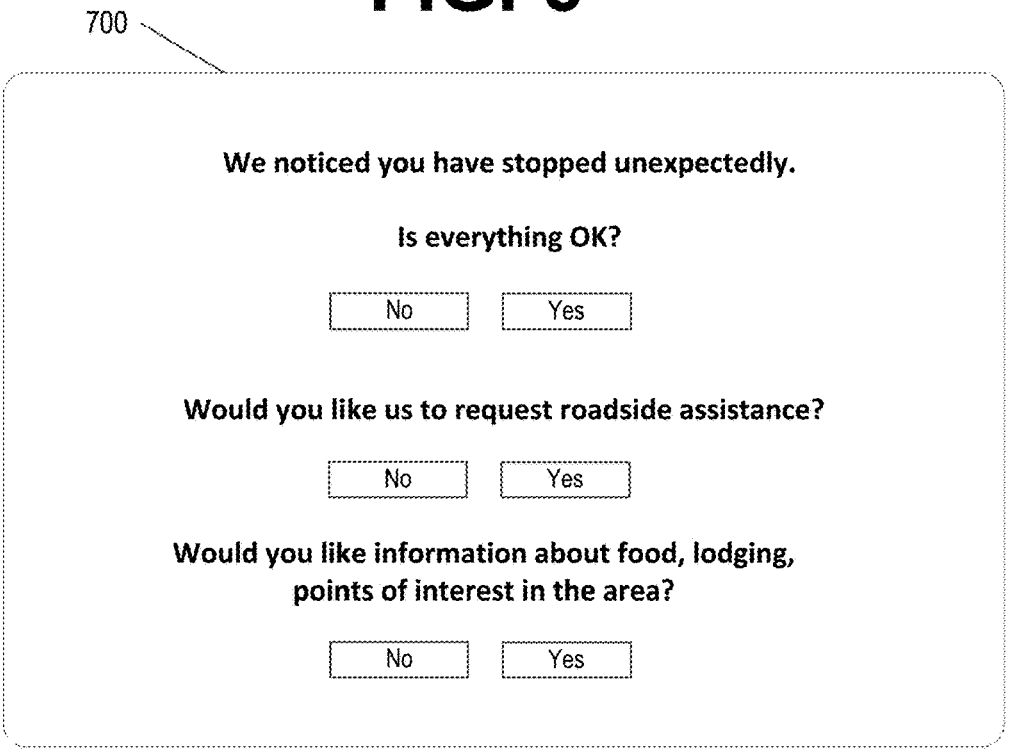
FIG. 7 illustrates one example user interface for providing a second type of notification to a display device in accordance with one or more aspects described herein.

FIG. 7 illustrates one example user interface 700 including a second type of notification. The second type of notification may include one or more selections available to the user (e.g., via user input to the device). For instance, the second type of notification may include a request for the user to confirm that everything is alright. Additionally or alternatively, the second type of notification may include a selectable offer for the system to request roadside assistance. In other examples, the second type of notification may include a selectable option to view additional information about an area surrounding the location (e.g., food, lodging, points of interest, and the like). More or fewer options may be provided to the user. The interface 700 is one example interface including a second type of notification and should not be viewed as limiting the second type of notification to only this information, arrangement, or the like.

In some examples, selection of one or more options available via user interface 700 may cause display of a second user interface having additional information, offers for assistance, or the like.

As discussed herein, the systems, arrangements, methods and the like, described herein provide an efficient and accurate system for monitoring vehicles travelling along a highway to detect issues that have caused the vehicle to stop. In some arrangements, the system may receive and/or process data in real-time in order to effectively and accurately identify vehicles that are stopped, determine a reason for stopping, and the like.

In some examples, a user may register his or her vehicle with the system in order to engage the monitoring aspect of the system. Registration may be performed via an online or mobile application executing one or more computing devices. Registration may include a user providing information about the vehicle (e.g., make, model, year, etc.), potential drivers (e.g., name, contact information, and the like). In some examples, the registration process may also include options for initiating the processes or systems described herein. For example, the registration process may include an option for "always on" which means the system may monitor the vehicle at all times to detect when the vehicle is on a highway, etc. In other examples, the user may select to have the system activate or initiate upon detecting a speed of the vehicle above a predetermined threshold (e.g., greater than 40 MPH, 50 MPH, 60 MPH, or the like, for a predetermined time). In another example, the system may activate or initiate upon a vehicle location being detected as on a highway or upon navigation information indicating that a user will be using a highway along a predetermined route. In still another example, a user may manually activate the system when approaching or planning to drive on a highway (e.g., via an online or mobile application). Various other arrangements for activating or initiating the system may be used without departing from the invention.

The arrangements described herein provide for receiving and processing data in real-time to efficiently and accurately detect stopped vehicles, determine whether the vehicle is stopped for an urgent or non-urgent situation reason, and provide assistance accordingly.

Various aspects described herein may be embodied as a method, an apparatus, or as one or more computer-readable media storing computer-executable instructions. Accordingly, those aspects may take the form of an entirely hardware embodiment, an entirely software embodiment, or an embodiment combining software and hardware aspects. Any and/or all of the method steps described herein may be embodied in computer-executable instructions stored on a computer-readable medium, such as a non-transitory computer readable medium. Additionally or alternatively, any and/or all of the method steps described herein may be embodied in computer-readable instructions stored in the memory of an apparatus that includes one or more processors, such that the apparatus is caused to perform such method steps when the one or more processors execute the computer-readable instructions. In addition, various signals representing data or events as described herein may be transferred between a source and a destination in the form of light and/or electromagnetic waves traveling through signal-conducting media such as metal wires, optical fibers, and/or wireless transmission media (e.g., air and/or space).

Aspects of the disclosure have been described in terms of illustrative embodiments thereof. Numerous other embodiments, modifications, and variations within the scope and spirit of the appended claims will occur to persons of ordinary skill in the art from a review of this disclosure. For example, one of ordinary skill in the art will appreciate that the steps illustrated in the illustrative figures may be performed in other than the recited order, and that one or more steps illustrated may be optional in accordance with aspects of the disclosure. Further, one or more aspects described with respect to one figure or arrangement may be used in conjunction with other aspects associated with another figure or portion of the description.

What is claimed is:

1. A breakdown detection computing platform, comprising:

at least one processor;

a communication interface; and at least one memory storing computer-executable instructions that, when executed by the processor, cause the breakdown detection computing platform to:

receive, in real-time, first data associated with a vehicle;

analyze the first data to determine a location of the vehicle;

determine, based on the location of the vehicle, whether the vehicle is on a highway;

responsive to determining that the vehicle is not on a highway, controlling one of an amount or type of data received by the breakdown detection computing platform to limit an amount or type of data received and analyzed to a first amount or type;

responsive to determining that the vehicle is on a highway, controlling one of an amount or type of data to increase an amount or type of data received by the breakdown detection computing platform to a second amount or type of data, the second amount being greater than the first amount;

receive, in real-time, second data associated with the vehicle;

analyze the second data to determine whether the vehicle is stopped;

responsive to determining that the vehicle is not stopped, continue to receive the second amount or type of data;

responsive to determining that the vehicle is stopped, determining whether the vehicle has exited the highway;

responsive to determining that the vehicle has exited the highway, controlling the amount or type of data received to limit the amount or type of data to the first amount or type of data;

responsive to determining that the vehicle has not exited the highway, determine whether the vehicle is stopped for an urgent situation reason or a non-urgent situation reason;

responsive to determining that the vehicle is stopped for an urgent situation reason, generate and transmit a first type of notification; and responsive to determining that the vehicle is stopped for a non-urgent situation reason, generate and transmit a second type of notification different from the first type of notification.

2. The breakdown detection computing platform of claim 1, further including instructions that, when executed, cause the breakdown detection computing platform to:

receive, in real-time and via vehicle-to-vehicle communications, data related to a speed of other vehicles at the determined location of the vehicle;

analyze the received data related to the speed of the other vehicles to determine whether the other vehicles are stopped;

responsive to determining that the other vehicles are stopped, determining that the vehicle is stopped for a non-urgent situation and generating and transmitting the second type of notification; and responsive to determining that the other vehicles are not stopped, determining that the vehicle is stopped for an urgent situation reason and generating and transmitting the first type of notification.

3. The breakdown detection computing platform of claim 1, further including instructions that, when executed, cause the breakdown detection computing platform to:

scan diagnostic codes of the vehicle;

determine, based on the scan of the diagnostic codes of the vehicle, whether the vehicle is stopped for an urgent situation reason or a non-urgent situation reason;

responsive to determining that the vehicle is stopped for an urgent situation reason, generate and transmit the first type of notification; and responsive to determining that the vehicle is stopped for a non-urgent situation reason, generate and transmit the second type of notification.

4. The breakdown detection computing platform of claim 3, wherein determining, based on the scan of the diagnostic codes of the vehicle, whether the vehicle is stopped for an urgent situation reason or a non-urgent situation reason further includes:

determining, based on the scan of the diagnostic codes, that no diagnostic codes are activated; and responsive to determining that no diagnostic codes have been activated, determining that the vehicle has stopped for a non-urgent situation reason.

5. The breakdown detection computing platform of claim 1, wherein the urgent situation reason is at least one of: low tire pressure, low fuel, low battery power, and low oil level.

6. The breakdown detection computing platform of claim 1, wherein first type of notification includes an indication that a request for roadside assistance has been submitted.

7. The breakdown detection computing platform of claim 1, wherein the second type of notification includes at least one of: an option to request roadside assistance and information about an area surrounding the location.

8. The breakdown detection computing platform of claim 1, wherein determining that the vehicle is stopped for an urgent situation reason further includes transmitting a request for assistance to a service center computing device.

9. A method, comprising:

at a computing platform comprising at least one processor, memory, and a communication interface:

receiving, by the at least one processor, via the communication interface and in real-time, first data associated with a vehicle;

analyzing, by the at least one processor, the first data to determine a location of the vehicle;

determining, by the at least one processor and based on the location of the vehicle, whether the vehicle is on a highway;

responsive to determining that the vehicle is not on a highway, controlling, by the at least one processor, one of an amount or type of data received by the computing platform to limit an amount or type of data received and analyzed to a first amount or type;

responsive to determining that the vehicle is on a highway, controlling, by the at least one processor, one of an amount or type of data to increase an amount or type of data received by the computing platform to a second amount or type of data, the second amount being greater than the first amount;

receiving, by the at least one processor, via the communication interface and in real-time, second data associated with the vehicle;

analyzing, by the at least one processor, the second data to determine whether the vehicle is stopped;

responsive to determining that the vehicle is not stopped, continuing to receive the second amount or type of data;

responsive to determining that the vehicle is stopped, determining, by the at least one processor whether the vehicle has exited the highway;

responsive to determining that the vehicle has exited the highway, controlling, by the at least one processor, the amount or type of data received to limit the amount or type of data to the first amount or type of data;

responsive to determining that the vehicle has not exited the highway, determining, by the at least one processor, whether the vehicle is stopped for an urgent situation reason or a non-urgent situation reason;

responsive to determining that the vehicle is stopped for an urgent situation reason, generating and transmitting a first type of notification; and responsive to determining that the vehicle is stopped for a non-urgent situation reason, generating and transmitting a second type of notification different from the first type of notification.

10. The method of claim 9, further including:

receiving, in real-time and via vehicle-to-vehicle communications, data related to a speed of other vehicles at the determined location of the vehicle;

analyzing, by the at least one processor, the received data related to the speed of the other vehicles to determine whether the other vehicles are stopped;

responsive to determining that the other vehicles are stopped, determining, by the at least one processor, that the vehicle is stopped for a non-urgent situation and generating and transmitting the second type of notification; and responsive to determining that the other vehicles are not stopped, determining, by the at least one processor, that the vehicle is stopped for an urgent situation reason and generating and transmitting the first type of notification.

11. The method of claim 9, further including:

scanning, by the at least one processor, diagnostic codes of the vehicle;

determining, by the at least one processor and based on the scan of the diagnostic codes of the vehicle, whether the vehicle is stopped for an urgent situation reason or a non-urgent situation reason;

responsive to determining that the vehicle is stopped for an urgent situation reason, generating and transmitting the first type of notification; and responsive to determining that the vehicle is stopped for a non-urgent situation reason, generating and transmitting the second type of notification.

12. The method of claim 11, wherein determining, based on the scan of the diagnostic codes of the vehicle, whether the vehicle is stopped for an urgent situation reason or a non-urgent situation reason further includes:

determining, by the at least one processor and based on the scan of the diagnostic codes, that no diagnostic codes are activated; and responsive to determining that no diagnostic codes have been activated, determining, by the at least one processor, that the vehicle has stopped for a non-urgent situation reason.

13. The method of claim 9, wherein the urgent situation reason is at least one of:

low tire pressure, low fuel, low battery power, and low oil level.

14. The method of claim 9, wherein first type of notification includes an indication that a request for roadside assistance has been submitted.

15. The method of claim 9, wherein the second type of notification includes at least one of: an option to request roadside assistance and information about an area surrounding the location.

16. The method of claim 9, wherein determining that the vehicle is stopped for an urgent situation reason further includes transmitting a request for assistance to a service center computing device.

17. One or more non-transitory computer-readable media storing instructions that, when executed by a computing platform comprising at least one processor, memory, and a communication interface, cause the computing platform to:

receive, in real-time, first data associated with a vehicle;

analyze the first data to determine a location of the vehicle;

determine, based on the location of the vehicle, whether the vehicle is on a highway;

responsive to determining that the vehicle is not on a highway, controlling one of an amount or type of data received by the computing platform to limit an amount or type of data received and analyzed to a first amount or type;

responsive to determining that the vehicle is on a highway, controlling one of an amount or type of data to increase an amount or type of data received by the breakdown detection computing platform to a second amount or type of data, the second amount being greater than the first amount;

receive, in real-time, second data associated with the vehicle;

analyze the second data to determine whether the vehicle is stopped;

responsive to determining that the vehicle is not stopped, continue to receive the second amount or type of data;

responsive to determining that the vehicle is stopped, determining whether the vehicle has exited the highway;

responsive to determining that the vehicle has exited the highway, controlling the amount or type of data received to limit the amount or type of data to the first amount or type of data;

responsive to determining that the vehicle has not exited the highway, determine whether the vehicle is stopped for an urgent situation reason or a non-urgent situation reason;

responsive to determining that the vehicle is stopped for an urgent situation reason, generate and transmit a first type of notification; and responsive to determining that the vehicle is stopped for a non-urgent situation reason, generate and transmit a second type of notification different from the first type of notification.

18. The one or more non-transitory computer-readable media of claim 17, further including instructions that, when executed, cause the computing platform to:

receive, in real-time and via vehicle-to-vehicle communications, data related to a speed of other vehicles at the determined location of the vehicle;

analyze the received data related to the speed of the other vehicles to determine whether the other vehicles are stopped;

responsive to determining that the other vehicles are stopped, determining that the vehicle is stopped for a non-urgent situation and generating and transmitting the second type of notification; and responsive to determining that the other vehicles are not stopped, determining that the vehicle is stopped for an urgent situation reason and generating and transmitting the first type of notification.

19. The one or more non-transitory computer-readable media of claim 17, further including instructions that, when executed, cause the computing platform to:

scan diagnostic codes of the vehicle;

determine, based on the scan of the diagnostic codes of the vehicle, whether the vehicle is stopped for an urgent situation reason or a non-urgent situation reason;

responsive to determining that the vehicle is stopped for an urgent situation reason, generate and transmit the first type of notification; and responsive to determining that the vehicle is stopped for a non-urgent situation reason, generate and transmit the second type of notification.

20. The one or more non-transitory computer-readable media of claim 19, wherein determining, based on the scan of the diagnostic codes of the vehicle, whether the vehicle is stopped for an urgent situation reason or a non-urgent situation reason further includes:

determining, based on the scan of the diagnostic codes, that no diagnostic codes are activated; and responsive to determining that no diagnostic codes have been activated, determining that the vehicle has stopped for a non-urgent situation reason.

* * * * *